US008971784B2

(12) United States Patent
Endo

(10) Patent No.: US 8,971,784 B2
(45) Date of Patent: Mar. 3, 2015

(54) WATER ADDITION APPARATUS AND IMAGE FORMING APPARATUS

(75) Inventor: Michiaki Endo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 426 days.

(21) Appl. No.: 13/457,895

(22) Filed: Apr. 27, 2012

(65) Prior Publication Data

US 2012/0288296 A1 Nov. 15, 2012

(30) Foreign Application Priority Data

May 13, 2011 (JP) ..... 2011-107797
Apr. 20, 2012 (JP) ..... 2012-097043

(51) Int. Cl.
*G03G 15/20* (2006.01)
*G03G 15/00* (2006.01)

(52) U.S. Cl.
CPC ..... *G03G 15/6576* (2013.01)
USPC ..... 399/341; 399/390; 399/406; 399/407

(58) Field of Classification Search
USPC ..... 399/341, 406
See application file for complete search history.

(56) References Cited

U.S. PATENT DOCUMENTS 4,652,110 A * 3/1987 Sato et al. ..... 399/406
5,264,899 A * 11/1993 Mandel ..... 399/341
5,850,589 A 12/1998 Cruz et al.
6,094,560 A * 7/2000 Thomas ..... 399/341
6,259,887 B1 * 7/2001 Awano ..... 399/390
8,290,419 B2 * 10/2012 Ogushi ..... 399/341
8,515,327 B2 * 8/2013 Hatazaki ..... 399/341
2005/0286946 A1 * 12/2005 Kougami et al. ..... 399/390
2006/0133876 A1 * 6/2006 Kougami et al. ..... 399/407
2009/0245908 A1 * 10/2009 Shida ..... 399/407
2010/0284717 A1 * 11/2010 Shida ..... 399/341
2012/0287450 A1 * 11/2012 Nishi ..... 358/1.9
2013/0331246 A1 * 12/2013 Kamiya et al. ..... 493/3

FOREIGN PATENT DOCUMENTS

JP 2005-164919 A 6/2005
JP 2006350263 A * 12/2006

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes a fixing portion that fixes a toner image to a sheet by applying heat to the sheet, a conveyance path through which back and forth conveyance of the sheet conveyed from the fixing portion is performed by normally and reversely rotating a conveying roller, and a water addition portion that adds water to the sheet at a water addition position in the conveyance path on upstream in a conveying direction of the conveying roller. In addition, a controller controls the water addition portion such that the water is added to the sheet conveyed from the fixing portion to the water addition position, and the water is added to the sheet to which the reverse conveyance has been performed after an upstream end in the conveying direction of the sheet passes through the water addition position.

16 Claims, 12 Drawing Sheets

FIG. 4A

| WATER AMOUNT IN SHEET IMMEDIATELY AFTER SPRAYING [%] | ELAPSED TIME [h] | COCKLING HEIGHT [mm] |
|---|---|---|
| 3.5 | 0 | 4.6 |
| | 48 | 3.8 |
| 5 | 0 | 2.3 |
| | 48 | 3.3 |
| 5.4 | 0 | 2.2 |
| | 48 | 4.5 |
| 5.7 | 0 | 2.0 |
| | 48 | 3.1 |
| 7.9 | 0 | 1.7 |
| | 48 | 5.5 |
| 8.3 | 0 | 1.6 |
| | 48 | 8.0 |

FIG. 4B

| 5.6% WATER AMOUNT IN SHEET AFTER 24 HOURS WITHOUT SPRAYING | | | |
|---|---|---|---|
| CHEMICAL | WATER AMOUNT IN SHEET [%] | | |
| | IMMEDIATELY AFTER SPRAYING | AFTER 1 HOUR | AFTER 24 HOURS |
| 50% CHOLINE CHLORIDE AQUEOUS SOLUTION | 10 | 6.8 | 6.6 |
| | 8.5 | 6.2 | 6.2 |

FIG. 4C

| CHEMICAL | DENSITY [%] | WATER AMOUNT IMMEDIATELY AFTER SPRAYING [%] | ELAPSED TIME [h] | COCKLING HEIGHT [mm] |
|---|---|---|---|---|
| WITHOUT SPRAYING | 0 | 4.4 (WITHOUT SPRAYING) | 0 | 4.5 |
| | | 5.5 | 48 | 3.5 |
| CHOLINE CHLORIDE | 50 | 7.7 | 0 | 1.6 |
| | | 6.0 | 48 | 2.2 |
| N-METHYLMORPHOLINE-N-OXIDE | 50 | 6.5 | 0 | 1.0 |
| | | 5.8 | 48 | 0.3 |

WATER ADDITION APPARATUS AND IMAGE FORMING APPARATUS

BACKGROUND OF THE INVENTION

1. Field of the Invention

The present invention relates to a water addition apparatus that adds water or an aqueous solution to a sheet in order to suppress wavy edge or curling of the sheet and an electrophotographic image forming apparatus provided with the water addition apparatus.

2. Description of the Related Art

Conventionally, in an electrophotographic image forming apparatus, an image (hereinafter referred to as a toner image) is visualized such that a development device develops an electrostatic latent image formed on a photosensitive drum that is of an image bearing member. The toner image is transferred to the sheet by an electrostatic force, and the toner image transferred to the sheet is heated and pressurized by a fixing device so that the image is fixed to the sheet, thereby forming an image on the sheet.

Frequently a thermal roller fixing type is adopted in the fixing device of the image forming apparatus. In the thermal roller fixing type fixing device, a fixing roller that includes a built-in heater and a pressure roller that is rotatably in contact with the fixing roller with a pressure constitute a fixing nip, and the sheet to which the toner image is transferred passes through the fixing nip to fix the toner image to the sheet.

In the thermal roller fixing type fixing device, the sheet is introduced to the fixing nip, which is formed by rotatably bringing the pressure roller including an elastic layer made of rubber into contact with the fixing roller, and the sheet is conveyed while nipped between the pressure roller and the fixing roller. At this point, a halogen heater is used as a heat source to heat the fixing roller, and the fixing roller is maintained at a predetermined temperature. Therefore, the unfixed toner image is thermally fixed to a surface of the sheet.

Through the fixing process, because the heat and the pressure are substantially simultaneously applied onto the sheet to which the toner image is transferred, water in the sheet is evaporated while the sheet is pressurized.

At this point, a phenomenon called "curling" in which the sheet is curved or a phenomenon called "wavy edge" in which the sheet is wavy is generated by a change in water amount in the sheet and a stress applied to the sheet.

Assume that most commonly used sheet-like paper is observed herein in terms of fiber. The paper is constructed by short fibers that are tangled up, and the water is present in or between the fibers. Smoothness of the paper is maintained because the fibers and the water are in an equilibrium state while a hydrogen bonding is generated.

However, when the heat and the pressure are substantially simultaneously applied to the paper in the fixing process, the fibers deviate from one another due to the pressure. At this point, when the paper is heated to evaporate the water, the hydrogen bonding is further generated between the fibers, resulting in a deformation of the paper. When the paper is left, the paper absorbs moisture from the surroundings, and the hydrogen bonding between the fibers is cut off again to return to the original state. However, the water does not invade in some fibers, and the deformation of the paper remains. A pattern of the deformation includes the curling and the wavy edges; the curling is generated by a difference in expansion and contraction between a surface and a backside of the paper, and the wavy edges are generated by the difference in expansion and contraction between a central portion and an end portion of the paper.

U.S. Pat. No. 5,850,589 discloses a solution to the problem. U.S. Pat. No. 5,850,589 describes an apparatus and a system, which are used to prevent the curling and the edge wavy edges caused by run-out of the water from the sheet in the fixing process of the electrophotographic image forming apparatus.

The apparatus described in U.S. Pat. No. 5,850,589 adds a controlled amount of water to a single side or double sides of the sheet. The apparatuses are disposed in both the surfaces of the sheet, and include a water jet having a reservoir in which a liquid is stored and a pair of pressure rollers having a cylindrical outer surface. The pair of pressure rollers is aligned along axes thereof such that a nip is formed between the cylindrical outer surfaces. The apparatus also includes a control device that controls the water added from the water jet to a selected portion of each passing sheet before the sheet enters the nip formed between the cylindrical outer surfaces.

In the case that the paper is used as the sheet, the water is added to the paper in which the water has been deprived by the heat and the pressure through the fixing process, whereby the lost water is supplied to reduce the curling and the wavy edges. As the amount of water in the paper is increased, a Young's modulus of the paper is decreased, stiffness of the paper then is decreased, and therefore the wavy edge is reduced. When the water invades in a gap between fibers, the hydrogen bonding between the fibers is cut off again by the fixing device, thereby reducing the wavy edge.

Recently, more image forming apparatuses with a higher speed are introduced in order to implement high productivity of the image forming apparatus, and there is a demand to enhance a recording sheet conveying speed. However, because a rate at which the water invades in the sheet is kept constant, a time during which the sheet passes through the water supply device becomes shortened as the recording sheet conveying speed is enhanced. Therefore, unfortunately the amount of water necessary to reduce the curling and the wavy edge cannot be supplied to the sheet.

An object of the present invention is to provide an image forming apparatus that can supply the water necessary to reduce the curling and the wavy edge to the sheet even when the sheet conveying speed is enhanced.

SUMMARY OF THE INVENTION

In order to achieve the object, there is provided an image forming apparatus including: a fixing portion that fixes a toner image to a sheet by applying heat to the sheet in which the toner image is formed; a conveyance path including a normally and reversely rotatable conveying roller, through which back and forth conveyance of the sheet conveyed from the fixing portion is performed by normally and reversely rotating the conveying roller; a water addition portion that adds water to the sheet at a water addition position in the conveyance path on upstream in a conveying direction of the conveying roller during the normal rotation of the conveying roller; and a controller that controls the water addition portion such that the water is added to the sheet conveyed from the fixing portion to the water addition position, and that the water is added to the sheet to which the reverse conveyance has been performed by the reverse rotation of the conveying roller after an upstream end in the conveying direction of the sheet during the normal rotation of the conveying roller passes through the predetermined water addition position.

According to the invention, the water is added to the sheet when the sheet is introduced into and taken out from the conveyance path, so that the water necessary to reduce the curling and the wavy edge is added to the sheet even when the sheet conveying speed is enhanced. Additionally, unevenness of the water added to the sheet can be prevented because the water is added to the sheet in two batches.

Further features of the present invention will become apparent from the following description of exemplary embodiments with reference to the attached drawings.

BRIEF DESCRIPTION OF THE DRAWINGS

FIGS. 4A, 4B, and 4C are tables illustrating experimental results of a relationship between a water amount in paper and an elapsed time;

DESCRIPTION OF THE EMBODIMENTS

First Embodiment

Exemplary embodiments of the present invention will be described in detail with reference to the drawings. Sizes, materials, shapes and relative positions of constituents described in the embodiments are appropriately changed according to configurations and various conditions of the apparatus to which the invention is applied. Therefore, the scope of the invention is not limited to the embodiments unless otherwise noted.

Figure 2:
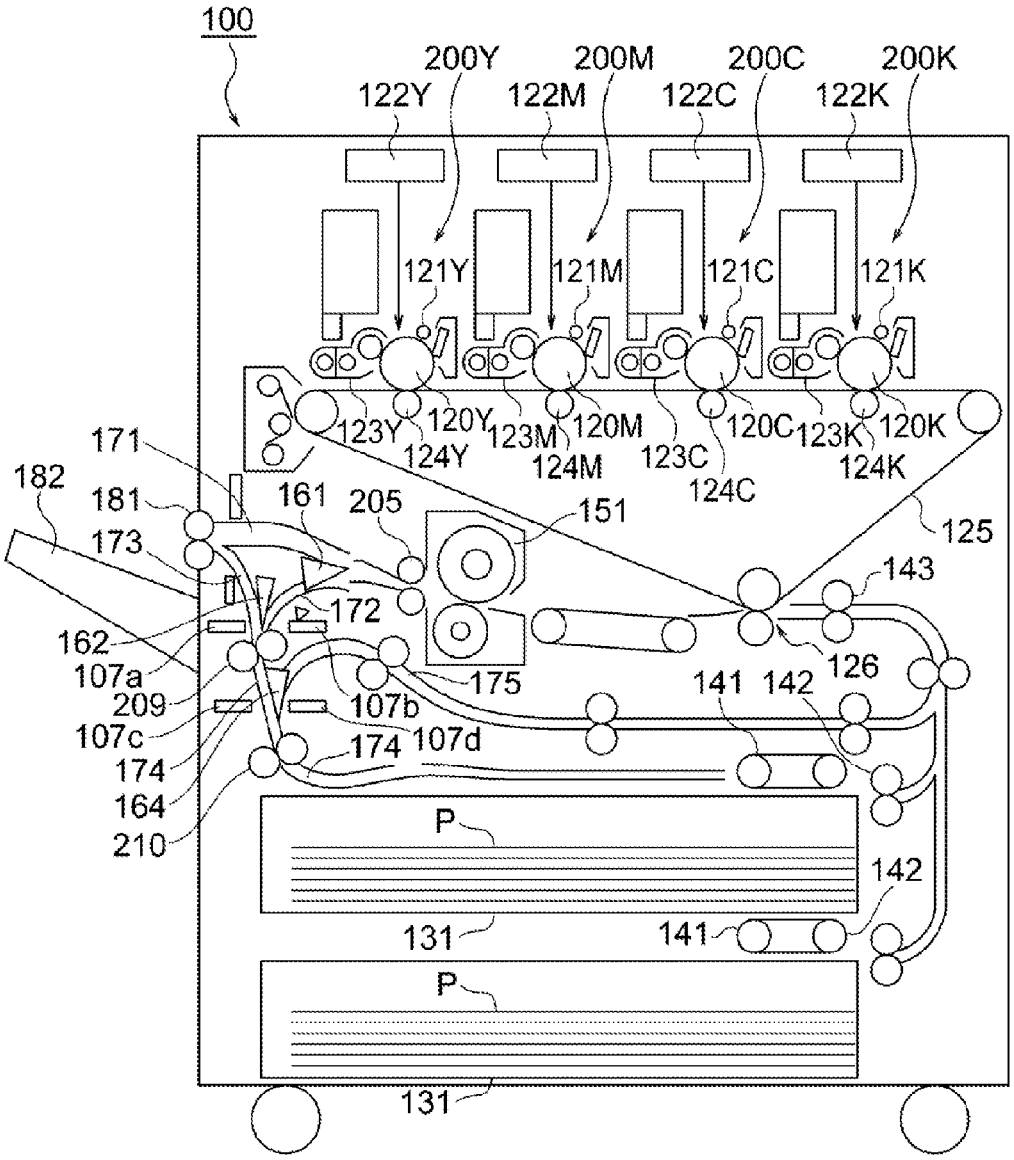
FIG. 2 is a schematic sectional view of an image forming apparatus.

FIG. 2 is a sectional view schematically illustrating a full-color intermediate transfer type image forming apparatus that is an example of an image forming apparatus according to an embodiment.

For example, an apparatus main body 100 of the image forming apparatus in FIG. 2 is constructed by arraying image forming portions 200Y, 200M, 200C, and 200K in series. The image forming portions 200Y, 200M, 200C, and 200K correspond to colors of Y (yellow), M (magenta), C (cyan), and K (black), respectively. The image forming apparatus is, in other words, a tandem system apparatus in which parallel processing is performed to processes to an image visualizing process using the colors is adopted.

Hereinafter, an image forming portion 200 represents the four image forming portions 200Y, 200M, 200C, and 200K for the colors Y, M, C, and K, and the same holds true for the related process portion described below. An array sequence of the image forming portions for the colors of Y, M, C, and K is not limited to the embodiment.

The following embodiments are applicable not only to the full-color intermediate transfer type image forming apparatus but also to a monochrome image forming apparatuses.

A flow to formation of a toner image will be described with reference to FIG. 2.

The image forming portion 200 includes the following process portions. The image forming portion 200 includes an image bearing member 120 that bears an electrostatic latent image on a surface thereof according to each of the colors Y, M, C, and K, a primary charging device 121, an exposure device 122, and a development device 123. The primary charging device 121 applies a charging bias voltage having a set potential to the surface of the corresponding image bearing member 120, thereby evenly charging the surface of the image bearing member 120. The exposure device 122 exposes the surface of the image bearing member 120 to form the electrostatic latent image. The electrostatic latent image is developed by the development device 123, and visualized as the toner image.

The toner images that are formed and borne on the surface of the image bearing members 120 are subjected to primary transfer by primary transfer devices 124 while sequentially superimposed on an intermediate transfer member 125 constructed by an endless belt. The toner images on the intermediate transfer member 125 onto which all the colors Y, M, C, and K are transferred are collectively secondary-transferred onto a sheet by a secondary transfer device 126.

A schematic sheet conveying route from sheet feeding to fixing will be described with reference to FIG. 2.

A sheet P set in a sheet cassette 131 starts a movement in response to a command of a copy button or the like of the apparatus main body 100. The sheet P in the sheet cassette 131 is selectively fed by a sheet feed roller 141, and separated by a pair of separation rollers 142, thereby only one sheet P is fed. The sheet is conveyed to a pair of registration rollers 143 by plural conveying rollers. Alignment of the sheet P relative to the secondary transfer device 126 is corrected by the pair of registration rollers 143, and the sheet P is conveyed after when the toner image is transferred to the sheet is adjusted by the secondary transfer device 126. The sheet P to which the toner image is transferred by the secondary transfer device 126 is conveyed to a fixing device 151.

Figure 1:
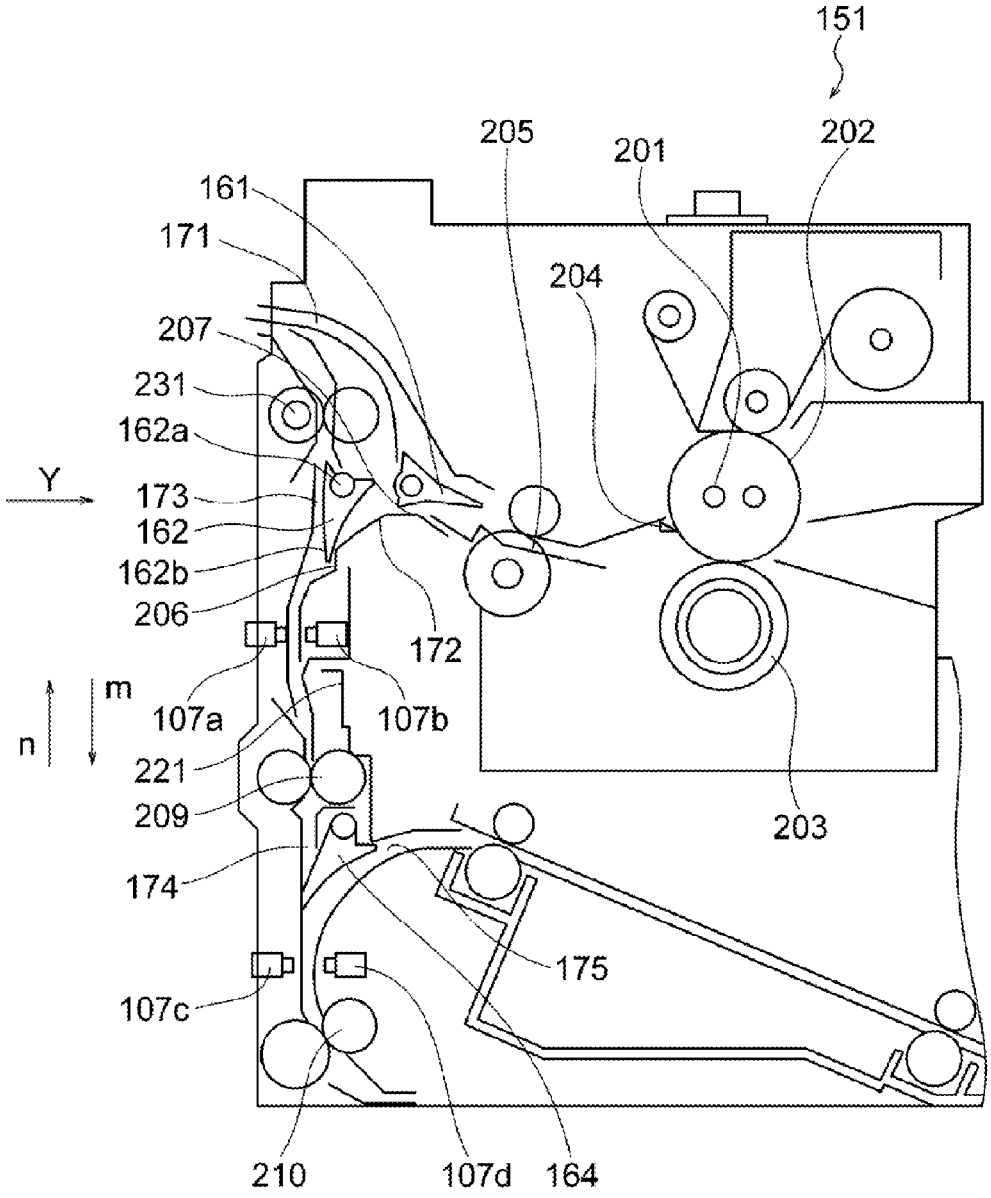
FIG. 1 is a sectional view of a sheet conveying route from a fixing device to a switchback path.

As illustrated in FIG. 1, in the fixing device (fixing portion) 151, the sheet is nipped at a fixing nip, and heat and a pressure are applied to the unfixed toner image, thereby fixing the toner image to the sheet. The fixing device 151 includes a halogen heater 201, a fixing roller 202 that is heated by the halogen heater 201, and a pressure roller 203 that is pressurized by the fixing roller 202 to form the fixing nip.

As to a material of the fixing roller 202, a roller made of high-tension steel is coated with a PFA tube. The fixing roller 202 has an outer diameter of 40.3 mm. The fixing roller 202 is heated to a temperature of about 180° C. by the halogen heater 201, and a contact type thermistor performs control such that the temperature of the fixing roller 202 is kept constant.

A sheet speed is set to 500 mm/s in a range from the secondary transfer device to the fixing device. The fixing roller 202 is rotated by a fixing motor (not illustrated) such that a circumferential velocity of the fixing roller 202 becomes 500 mm/s.

In the pressure roller 203, a silicone rubber having a thickness of about 3 mm is bonded to a steel roller having a diameter of 32 mm, and the outside of the silicone rubber is coated with the PFA tube. The pressure roller 203 has an outer diameter of 38 mm. The pressure roller 203 pressurizes the fixing roller 202 with a pressurization force of about 100 Kg by a spring, the pressure roller 203 is driven by the rotation of the fixing roller 202, and the toner image is fixed to the sheet by the heat and the pressure while the sheet nipped at the fixing nip is conveyed.

The sheet is peeled off from the fixing roller 202 by a separation claw 204, and conveyed by a pair of inner discharge rollers 205, thereby the sheet is discharged to the outside of the fixing device.

A flow of the sheet after the sheet passes through the fixing device will be described with reference to FIGS. 1 and 2. A conveying route for face-down discharge where, after passing through the fixing device, the sheet in which the image has been formed on the surface is discharged while placed face down and a conveying route for the formation of a double-sided image in which the images are formed on double sides of the sheet will be described below in order.

(For Face-Down Discharge) In discharging the sheet from the apparatus main body, the case that the sheet in which the image formation on the surface has been completed is discharged onto a discharge tray 182 while placed face down is called the face-down discharge.

After the toner image is fixed to the sheet by the fixing nip, the sheet is discharged to the outside of the fixing device 151 by the pair of inner discharge rollers 205. A position of a switching member 161 remains in the state in FIG. 2, and the sheet enters a conveying route 172. That is, the sheet enters a first switchback path (switchback conveyance path). The first switchback path is a path to reverse a sheet to be discharged, and includes a reverse switching member 162 and a pair of reverse rollers 209 that is normally and reversely rotatable.

The sheet introduced in the first switchback path pushes away the reverse switching member 162 biased onto a side of a guide 206 (see FIG. 1) by a spring such that the reverse switching member 162 is turned to a rotation center 162*a* by rigidity of the sheet, and the sheet is conveyed in a direction of an arrow m by the normally-rotating pair of reverse rollers 209.

Then the sheet enters a second switchback path. The second switchback path is a path to reverse a sheet in which double-sided image formation is to be performed, and includes a double-sided switching member 164 and a pair of double-sided rollers 210 that are normally and reversely rotatable. The sheet entering the second switchback path pushes away the double-sided switching member 164 biased by a spring such that the double-sided switching member 164 is turned by the rigidity of the sheet, and the sheet is conveyed in the direction of the arrow m by the two pairs of conveying rollers, namely, the pair of reverse rollers 209 and the pair of double-sided rollers 210.

The pair of reverse rollers 209 and the pair of double-sided rollers 210 temporarily stop the rotations in a position in which a tailing end of the sheet proceeds from an end portion 162*b* of the reverse switching member 162 by a predetermined amount (in this case, 10 mm). Water addition apparatuses 107*a* and 107*b* that are the first water addition portion are disposed in the position.

The water addition apparatuses 107*a* and 107*b* are the water addition portions that add the water to the sheet that has passed through the fixing device 151. The water addition apparatuses 107*a* and 107*b* are provided in the first switchback path. The water addition apparatuses 107*a* and 107*b* are disposed on the surface side and backside of the sheet while facing each other across the sheet conveying path, and are provided so as to add the water to a single side or double sides of the sheet. Detailed configurations and operations of the water addition apparatuses 107*a* and 107*b* are described later.

The pair of reverse rollers 209 and the pair of double-sided rollers 210, in which the rotations are temporarily stopped, are reversely rotated to perform the reverse conveyance of the sheet in a direction of an arrow n opposite to the direction of the arrow m. The sheet passes through the reverse switching member 162 again. At this point, the end portion 162*b* of the reverse switching member 162 biased to the guide 206 by the spring enters a step provided in the guide 206. Therefore, the sheet is guided to a conveying route 173 while not hooked by the end portion 162*b* of the reverse switching member 162. The sheet guided to the conveying route 173 is introduced to a pair of outer discharge rollers 181 (see FIG. 1) by a pair of reverse discharge rollers 231 (see FIG. 2). Then, the sheet is discharged onto the discharge tray 182 by the pair of outer discharge rollers 181 while placed face down, and the sheet is stacked on the discharge tray 182.

(For Double-Sided Image Formation) After the toner image is fixed to the sheet in which the image formation on the surface has been completed by the fixing nip, the sheet is discharged to the outside of the fixing device 151 by the pair of inner discharge rollers 205, and guided to the conveying route 172 by the switching member 161. Then the flow of the sheet is identical to that of the face-down discharge until the sheet is conveyed by the pair of reverse rollers 209 and the pair of double-sided rollers 210.

For the double-sided image formation, the sheet enters deep into the pair of a conveying route 174 by the pair of reverse rollers 209. Specifically, the pair of double-sided rollers 210 conveys the sheet to the position in which the tailing end of the sheet proceeds from the double-sided switching member 164 by the predetermined amount (in this case, 10 mm). At this point, the pair of reverse rollers 209 and the pair of double-sided rollers 210 temporarily stop the rotations. Water addition apparatuses 107*c* and 107*d* that are the second water addition portions are disposed in the position.

Similarly to the water addition apparatuses 107*a* and 107*b*, the water addition apparatuses 107*c* and 107*d* are the water addition portions that add the water to the sheet that passes through the fixing device 151. The water addition apparatuses 107*c* and 107*d* are provided in the second switchback path. The water addition apparatuses 107*c* and 107*d* are disposed on the surface side and backside of the sheet while facing each other across the sheet conveying route, and are provided so as to add the water to the single side or double sides of the sheet. Detailed configurations and operations of the water addition apparatuses 107*c* and 107*d* are described later.

The pair of reverse rollers 209 and the pair of double-sided rollers 210, in which the rotations are temporarily stopped, are reversely rotated to perform the reverse conveyance of the sheet in the direction opposite to the direction of the arrow m. Therefore, the sheet is guided to a conveying route 175 by the double-sided switching member 164 biased by the spring. At this point, the double-sided switching member 164 is located in the position in FIG. 1 while biased by the spring. At this point, a relationship between the end portion of the double-sided switching member 164 and the guide constituting the conveying route is identical to the relationship between the reverse switching member 162 and the guide 206 described above. Therefore, the sheet is guided to the conveying route 175 while not hooked by the end portion of the double-sided switching member 164. The sheet guided to the conveying route 175 is conveyed to the transfer portion again while placed face down.

After the sheet is conveyed to the transfer portion, the image is formed on the backside of the sheet through the same process as the sheet in which the image is formed on the surface is conveyed as described above, and the double-sided image formation is completed. The sheet in which the double-sided image formation is completed passes through the conveying route 171 for face-up discharge, and the sheet is discharged to and stacked on the discharge tray 182 outside of the apparatus main body by the pair of outer discharge rollers 181.

(Water Addition Apparatus in Switchback Path) The water addition apparatus will be described with reference to FIG. 3. As described above, the water addition apparatus is provided in the switchback path through which the switchback conveyance of the sheet is performed in order to inverse the surface of the sheet. FIG. 3 is a schematic diagram of the water addition apparatus provided in the switchback path.

Because the first water addition apparatuses 107*a* and 107*b* are identical to the second water addition apparatuses 107*c* and 107*d* in the configuration, the water addition apparatuses 107*c* and 107*d* provided in the second switchback path are described by way of example.

Figure 3A:
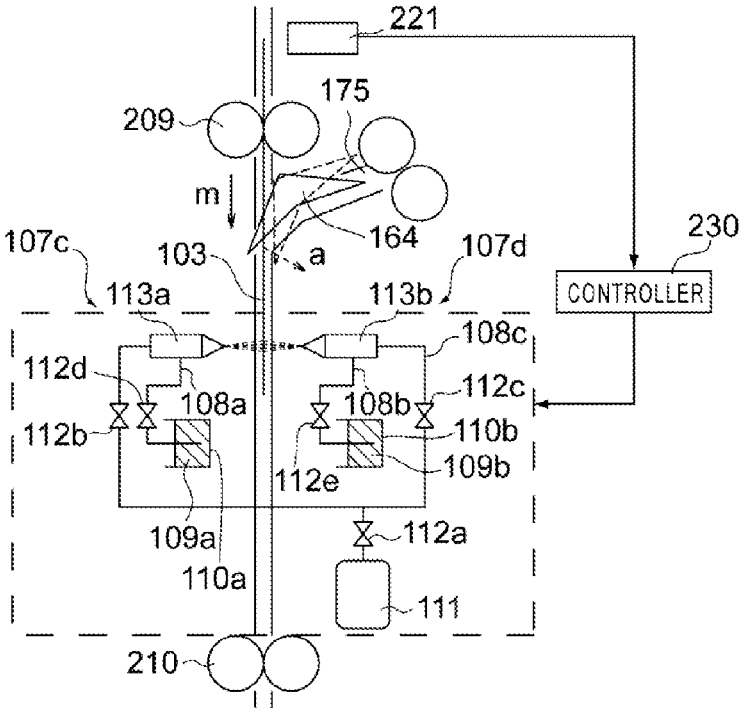
FIGS. 3A and 3B are schematic sectional views of the switchback path.

FIG. 3A illustrates a state in which the leading end of the sheet reaches a water addition position of the water addition apparatus after the sheet enters the second switchback path. As used herein, the water addition position of the water addition apparatus means positions of spray nozzles 113*a* and 113*b* that are included in each of the first water addition apparatuses 107*a* and 107*b* and the second water addition apparatuses 107*c* and 107*d*.

A reverse sensor 221 detects the leading end of the sheet. The reverse sensor 221 is the sheet detector that detects the end portion of the sheet. A reflection type sensor is used as the reverse sensor 221. A timer of a controller (control portion) 230 provided in the apparatus main body is started when the reverse sensor 221 detects the leading end of the sheet. That is, based on a detection signal of the reverse sensor 221, the controller 230 that is the control portion provided in the apparatus main body determines whether the sheet is introduced in the switchback path and whether the sheet is taken out from the switchback path, and therefore the controller 230 controls the operations of the water addition apparatuses 107*c* and 107*d*.

As described above, the sheet is conveyed in the direction of the arrow m by the pair of reverse rollers 209. The double-sided switching member 164 biased by the spring is turned to a direction of an arrow a by the rigidity of the sheet. The sheet is introduced in the second switchback path and conveyed to the water addition apparatuses 107*c* and 107*d*. The time the sheet reaches the water addition position of the water addition apparatus 208 is measured by a count of the timer, the water addition (water spraying) to the sheet is started according to the time the leading end of the sheet reaches the water addition positions of the water addition apparatuses 107*c* and 107*d*.

Figure 3B:
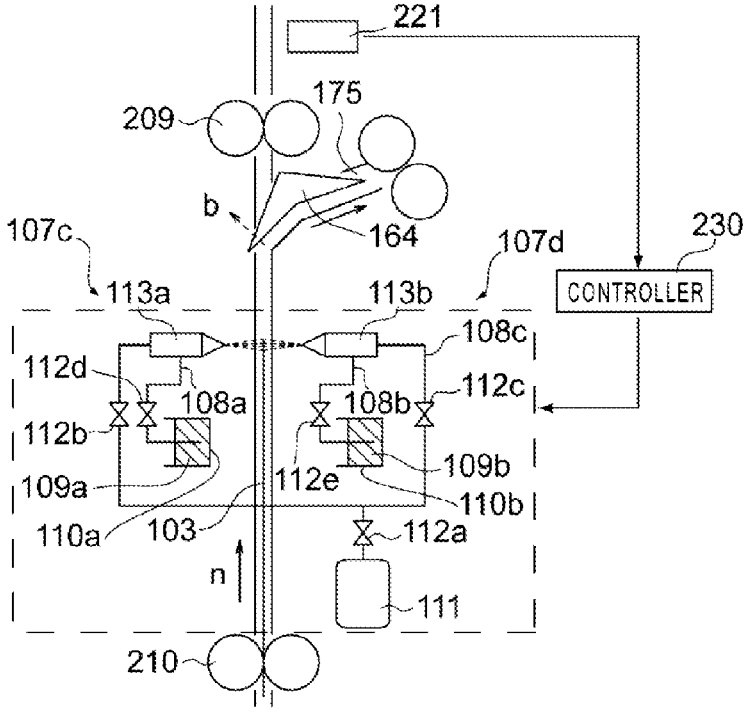

FIG. 3B illustrates a state, in which the sheet is further conveyed to reach the pair of double-sided rollers 210 and the tailing end of the sheet reaches the water addition position of the water addition apparatus.

When the tailing end (an upstream end in the conveying direction) of the sheet P introduced in the second switchback path passes through the water addition positions (positions shown in FIG. 3B) of the water addition apparatuses 107*c* and 107*d* by a predetermined amount, the pair of reverse rollers 209 and the pair of double-sided rollers 210 temporarily stop the rotations. Then the pair of double-sided rollers 210 starts the reverse rotation to perform the reverse conveyance of the sheet in the direction of the arrow n opposite to the direction of the arrow m. At this time point, the double-sided switching member 164 is turned to a direction of an arrow b by the biasing force of the spring and returned to the position (solid-line position) in FIG. 4. Therefore, the sheet is taken out from the second switchback path and conveyed to the conveying route 175 by the double-sided switching member 164, thereby the sheet is inverted.

The water addition apparatuses 107*c* and 107*d* perform the water addition (water spraying) to the sheet P until the end portion of the sheet passes through the water addition position of the water addition apparatus. FIG. 5 is a timing chart illustrating the state. FIG. 6 is a flowchart illustrating the flow of the operation.

As illustrated in FIGS. 5 and 6, the reverse sensor detects the leading end of the sheet in Step S301, and the controller receives the signal from the reverse sensor to start a timer Ta in Step S302. When a predetermined time t2 elapses by the timer Ta in Step S303, the water addition apparatus is activated in Step S304. Therefore, the water addition apparatus performs the first-time water addition to the sheet introduced in the switchback path.

The reverse sensor detects the tailing end of the sheet in Step S305, and the controller receives the signal from the reverse sensor to start timers Tb and Tc in Step S306. When a predetermined time t3 elapses by the timer Tb in Step S307, the pairs of rollers 209 and 210 are temporarily stopped in Step S308, and the pairs of rollers 209 and 210 start the reverse rotation in Step S309. That is, as described above, the reverse rotation of the pair of double-sided rollers 210 is started according to the time the tailing end of the sheet passes through the water addition position of the water addition apparatus. Therefore, the water addition apparatus performs the second-time water addition to the sheet taken out from the switchback path.

When the predetermined time t3 elapses by the timer Tc in Step S310, the water addition apparatus is stopped in Step S311, and the water addition is ended. The operation to add the water to the sheet twice is completed.

In FIG. 5, a vertical axis indicates a distance from the fixing roller to each member position, and a horizontal axis indicates a time necessary for the sheet to reach each member position from the fixing roller. FIG. 5 illustrates a state in which an A4-size sheet proceeds from the fixing roller until passing through the water addition position of the water addition apparatus.

Figure 5A:
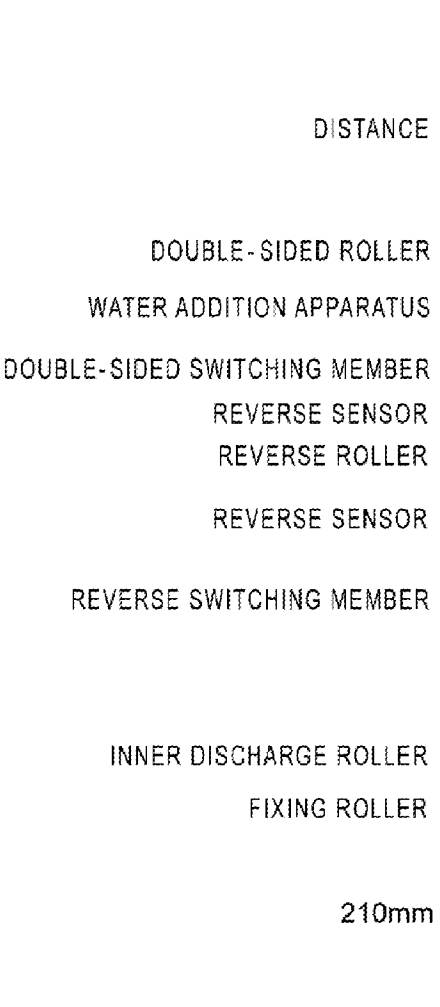
FIGS. 5A and 5B are timing charts illustrating when a sheet passes through between the fixing device and a water addition apparatus.

FIG. 5A illustrates a state in which the sheet P proceeds in the direction of the arrow m in FIG. 3, a solid line indicates the leading end of the sheet, and a broken line indicates the tailing end of the same sheet. Because of the A4-size sheet, the distance from the leading end to the tailing end is 210 mm. In FIG. 5, gradients of the solid line and broken line are the sheet conveying speed, and the fixing portion has the sheet conveying speed of 500 mm/s.

The time necessary for the tailing end of the sheet to pass through the fixing nip can be obtained by detecting the leading end of the sheet by the reverse sensor. After the predetermined time elapses, the conveying speed of the pair of reverse rollers is increased to 500 to 750 mm/s. Therefore, the distance between the sheet and the subsequent sheet is ensured such that the sheets do not collide with each other in the double-sided switching member.

After the predetermined time elapses since the reverse sensor detects the leading end of the sheet, the sheet reaches the water addition position of the water addition apparatus and the water addition apparatus sprays the water (adds the water) as the sheet reaches the water addition position. The sheet is continuously conveyed while the water addition apparatus sprays the water, and the sheet is conveyed until the tailing end of the sheet passes through the water addition position of the water addition apparatus (a position in which the broken line in FIG. 5 intersects the water addition apparatus). The timing is detected by the reverse sensor and controlled by the controller.

Figure 5B:
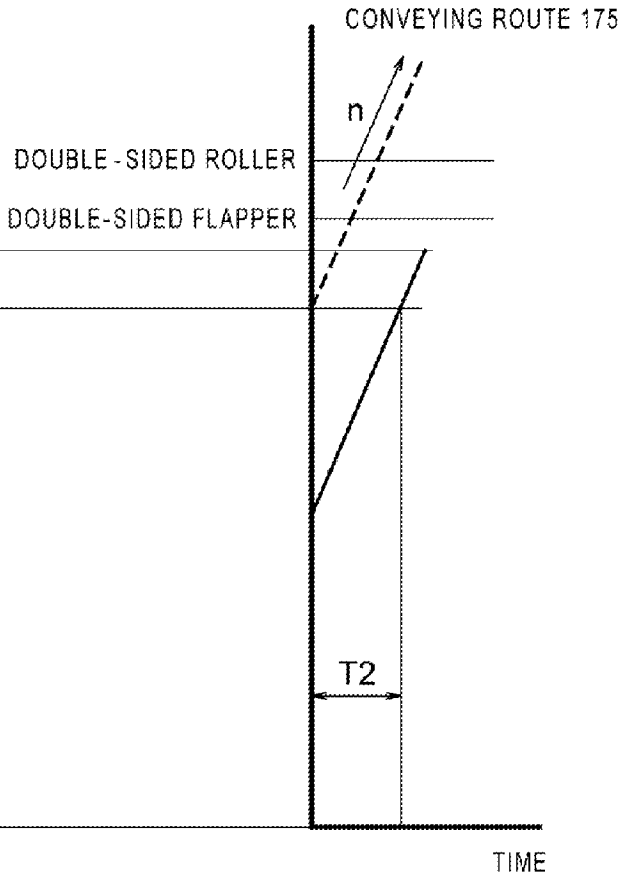
Figure 6:
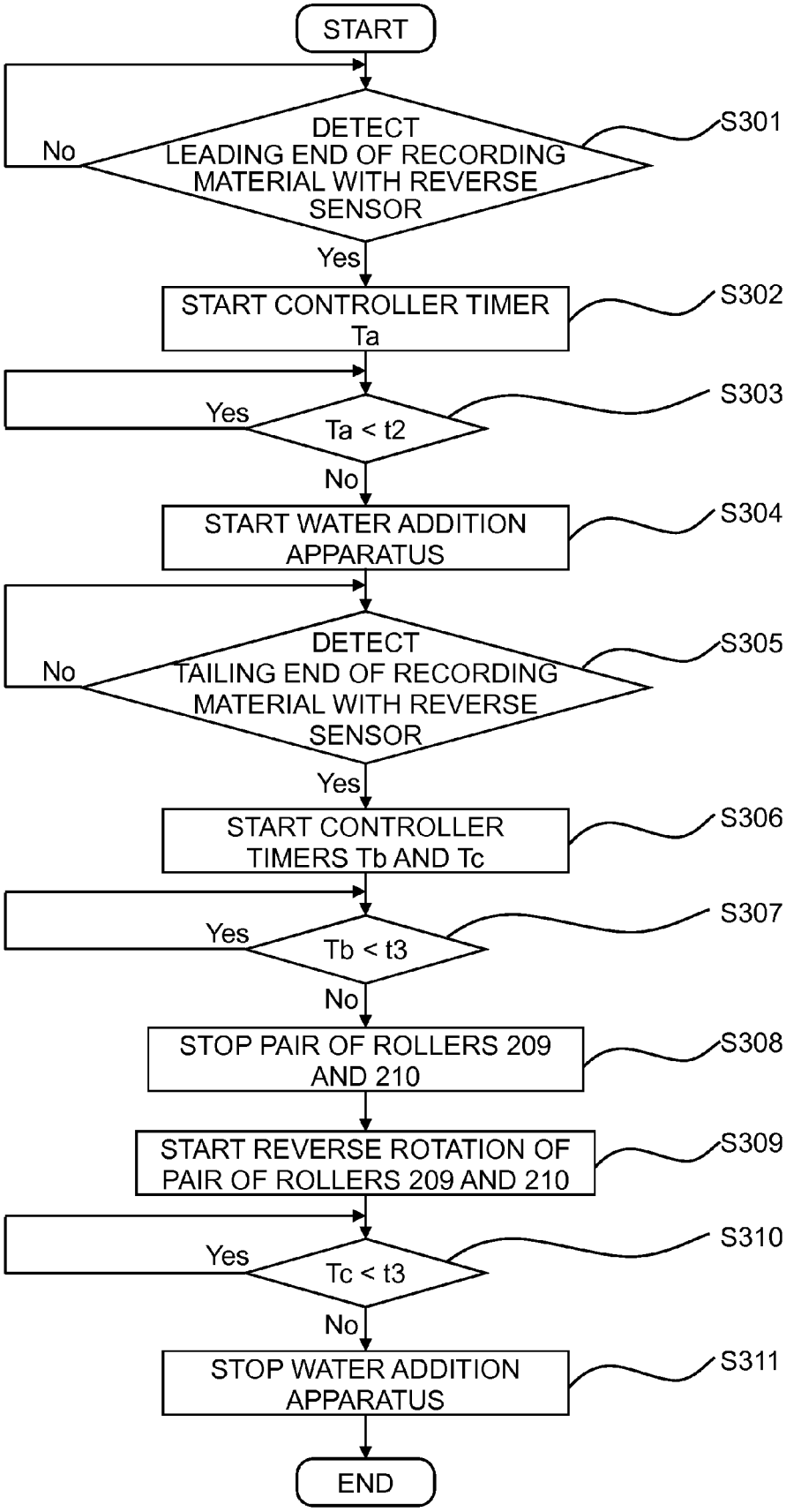
FIG. 6 is a flowchart illustrating a flow of a switchback operation and an operation of the water addition apparatus.

When the tailing end of the sheet passes through the water addition position of the water addition apparatus, the pair of reverse rollers and the pair of double-sided rollers temporarily stop the conveyance of the sheet in the direction of the arrow m. Then, the pair of reverse rollers and the pair of double-sided rollers start the reverse rotation to convey the sheet in the direction of the arrow n, the double-sided switching member 164 conveys the sheet in the direction of the conveying route 175 to guide the sheet to the conveying route for the double-sided image formation. FIG. 5B illustrates a state in which the sheet proceeds to the conveying route 175, and the broken line and the solid line are replaced with each other because the tailing end of the sheet, which is conveyed in the direction of the arrow m in FIG. 5A, becomes the leading end in turn.

Assuming that T1 is a water addition time in the case that the water addition apparatus is disposed immediately after the fixing roller as in the conventional way, the water addition time T1 is 0.42 second when the A4-size sheet (having a length of 210 mm in the conveying direction) is conveyed at the conveying speed of 500 mm/s. On the other hand, in the first embodiment, the water addition apparatus is disposed in the sheet switchback path, so that the water can be added to the sheet for the time in which the time T1 during which the sheet is introduced in the switchback path and the time T2 during which the sheet is taken out from the switchback path are added. The conveying speed of the first embodiment is faster than the conventional conveying speed (in this case, 750 mm/s). However, because of the switchback conveyance, the time (T1+T2) becomes 0.56 second which is double the time of 0.28 second during which the A4-size sheet passes through the water addition apparatus at the conveying speed of 750 mm/s. Therefore, in the first embodiment, although the sheet conveying speed is faster than the conventional sheet conveying speed, the water can be added to the sheet for the longer time than ever before.

The sheet cannot completely absorb the water even if the large amount of water is added to the sheet at one time, but water absorption efficiency of the sheet is increased when the small amount of water is added to the sheet in two batches. Therefore, the effect of reducing the curling and the wavy edge is further enhanced when the water is added to the sheet in two batches.

Additionally, when the water is added to the sheet in two batches, the unevenness of the water added to the sheet (a difference between the spot at which the large amount of water is added and the spot at which the small amount of water is added) is eliminated, and the curling and the wavy edge are further reduced to output the good print product. Because, in the sheet in which the first image is formed, the water is lost through the fixing process, the water is supplied to the sheet to eliminate the wavy edge before the second image is formed. Accordingly, the good second image is formed.

In the first embodiment, the spray nozzle is used as the water addition apparatus. The water addition apparatus in FIGS. 3A and 3B will be described below. The water addition apparatuses 107*c* and 107*d* are disposed on the surface side and backside of the sheet while facing each other across the sheet conveying path (the same holds true for the water addition apparatuses 107*a* and 107*b*).

In order to spray a solution 109 as the water to the sheet, the water addition apparatuses 107*c* and 107*d* include spray nozzles 113*a* and 113*b*, respectively. The water addition apparatuses 107*c* and 107*d* include a compressor 111 in order to supply compressed air to the spray nozzles 113*a* and 113*b*. At this point, the one compressor 111 supplies the compressed air to the two spray nozzles by way of example. Alternatively, compressors may be provided in the two spray nozzles, respectively.

The water addition apparatuses 107*c* and 107*d* include reservoirs 110*a* and 110*b* in order to supply the solution 109 to the spray nozzles 113*a* and 113*b*, respectively. The water addition apparatuses 107*c* and 107*d* also include tubes 108*a* and 108*b* that supply the solution 109 from the reservoirs 110*a* and 110*b* to the spray nozzles 113*a* and 113*b* and valves 112*d* and 112*e* that start and stop the supply of the solution 109. The water addition apparatuses 107*c* and 107*d* also include a tube 108*c* that supplies the compressed air from the compressor 111 to the spray nozzles 113*a* and 113*b* and valves 112*a* to 112*c* that start and stop the supply of the compressed air.

Thus, the water addition apparatuses 107*c* and 107*d* are provided in the switchback path, and the solution 109 is sprayed to the sheet from the spray nozzles 113*a* and 113*b* of the water addition apparatuses 107*c* and 107*d*. The water is added from the spray nozzles 113*a* and 113*b* to the single side or double sides of the sheet 103 according to the condition of the image on the sheet.

Although the spray nozzle is used in the first embodiment, there are various mechanisms which add the water to the sheet, including a water-jet mechanism and an applying roller. Therefore, the water addition apparatus of the present invention is not limited to the spray nozzle.

Because the sequence of the water addition apparatuses 107*a* and 107*b* disposed between the first switchback path (between the reverse switching member 162 and the pair of reverse rollers 209) is identical to that in the double-sided image formation, the description will not be repeated. For the sheet in which the image is formed only on the single side, during the face-down discharge of the sheet from the first switchback path, the water is added to the sheet in two batches in the water addition positions of the water addition apparatuses 107*a* and 107*b* by the same water addition configuration and sequence as those of the double-sided image formation. Similarly to the double-sided image formation, the small amount of water is added in two batches to enhance the water absorption efficiency of the sheet, and the curling and the wavy edge are further reduced effectively.

Second Embodiment

Figure 10:
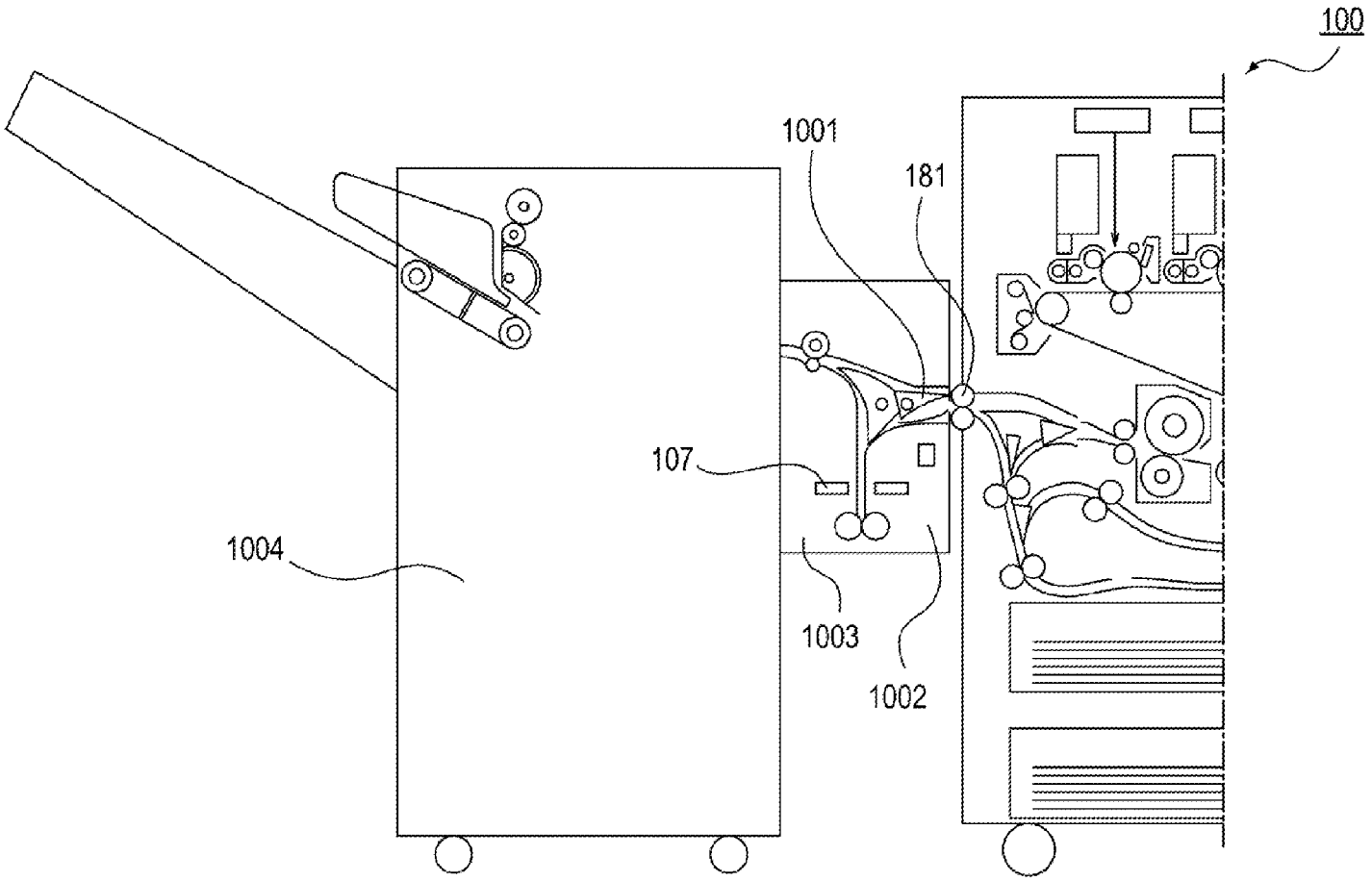
FIG. 10 is a sectional view schematically illustrating a configuration in which a water addition apparatus is attached as an option between the image forming apparatus main body and a sheet processing apparatus.

FIG. 10 illustrates a configuration in which a water addition apparatus 1002 is attached as an option between the image forming apparatus main body 100 and a sheet processing apparatus 1004.

The sheet discharged by the outer discharge roller 181 of the image forming apparatus main body 100 is conveyed from an introduction port 1001 of the water addition apparatus 1002 to the sheet processing apparatus 1004.

The water addition apparatus 107 that serves as the water addition portion is provided in the water addition apparatus 1002, and the water is added using the water addition apparatus 107 while the sheet is inverted. In the second embodiment, the switchback path of the image forming apparatus main body 100 inverts the sheet, but the water addition apparatus is not provided in the switchback path.

In inverting the sheet, because the water addition configuration and sequence are identical to those of the first embodiment, the description will not be repeated. Similarly to the first embodiment, in the switchback portion, the spray nozzle (water addition position) is disposed on the upstream side of a reverse roller 1003 when the reverse roller 1003 is normally rotated. Because the spray nozzle is identical to that of the first embodiment, the description will not be repeated.

The sheet processing apparatus 1004 processes the large amount of sheets discharged from the image forming apparatus main body 100 at a high speed. Therefore, when the sheet that passes through the fixing device to lose the water is directly conveyed, and when the sheets are processed as a sheet bundle while the sheet has curling and the wavy edge, possibly the sheets are processed while not aligned. However, the water addition apparatus 1002 attached between the image forming apparatus main body 100 and the sheet processing apparatus 1004 adds the water to the sheet, which allows the curling and the wavy edge to be reduced. The sheets are processed in the form of a bundle so as to be able to perform the good sheet processing.

In the description so far, the curling and wavy edge of the sheet are reduced by adding the water to the sheet. The water added to the sheet is not limited to the description.

For example, the aqueous solution containing a deliquescent material that takes in the moisture in air is used as the spraying solution (water) to further improve permeability to the sheet. When the deliquescent material is contained, the solution invades easily between the fibers of the paper, the effect of cutting off the hydrogen bonding between the fibers is enhanced, and the curling and wavy edge of the paper can be reduced. Alternatively, an aqueous solution containing a surfactant having a hydrophilic group and a hydrophobic group can be used as the spraying solution so that adhesion of the sheet to upper and lower sheets can be reduced in stacking the sheets while permeability to the sheet is improved. The details are described below.

Using the water addition apparatus (solution spraying apparatus) in FIGS. 3A and 3B, only the water is sprayed to the sheet immediately after the sheet passing of the electrophotographic image forming apparatus, and a sheet wavy edge amount is measured when the amount of water added to the sheet is changed.

A sheet (product of Canon, CLC of 80 g, size of A3, machine direction of CD), the image in which the toner image does not exist (solid white), and single-side sheet passing are used. In surroundings of the sheet that is of a product, the temperature is set to about 23° C., and humidity is set to about 40%. At this point, in the fixing roller 202 of the electrophotographic image forming apparatus, the temperature is set to 180° C., and the circumferential velocity is set to 500 mm/sec.

FIG. 4A illustrates the results. Compared with the sheet in which the water is not sprayed immediately after the sheet passes through the electrophotographic image forming apparatus, the wavy edge height is reduced in the sheet in which the water is sprayed using the water addition apparatus immediately after the sheet passes through the electrophotographic image forming apparatus. When the amount of water added to the sheet is increased, the wavy edge tends to be reduced in the sheet having the larger water amount immediately after the water addition. On the other hand, when the water amount of the sheet is in equilibrium with the surroundings after 48 hours, the wavy edge tends to be larger with the larger spraying amount. This is attributed to the fact that the evenly-sprayed water has been unevenly evaporated with time.

From the results in FIG. 4A, it is considered that the wavy edge remains reduced when the water amount immediately after the spraying can be retained.

Therefore, as described above, the aqueous solution containing the deliquescent material that takes in the moisture in air is used as the spraying water. The deliquescent material takes in the moisture in air to become the aqueous solution, and the deliquescent material continuously absorbs the moisture until a density of the aqueous solution reaches a given value. The deliquescent material and the water are mixed to make the aqueous solution, and the aqueous solution is sprayed to the sheet. Accordingly, the curling and wavy edge of the sheet is reduced by the added water, and the added water is maintained in the sheet.

Figure 7:
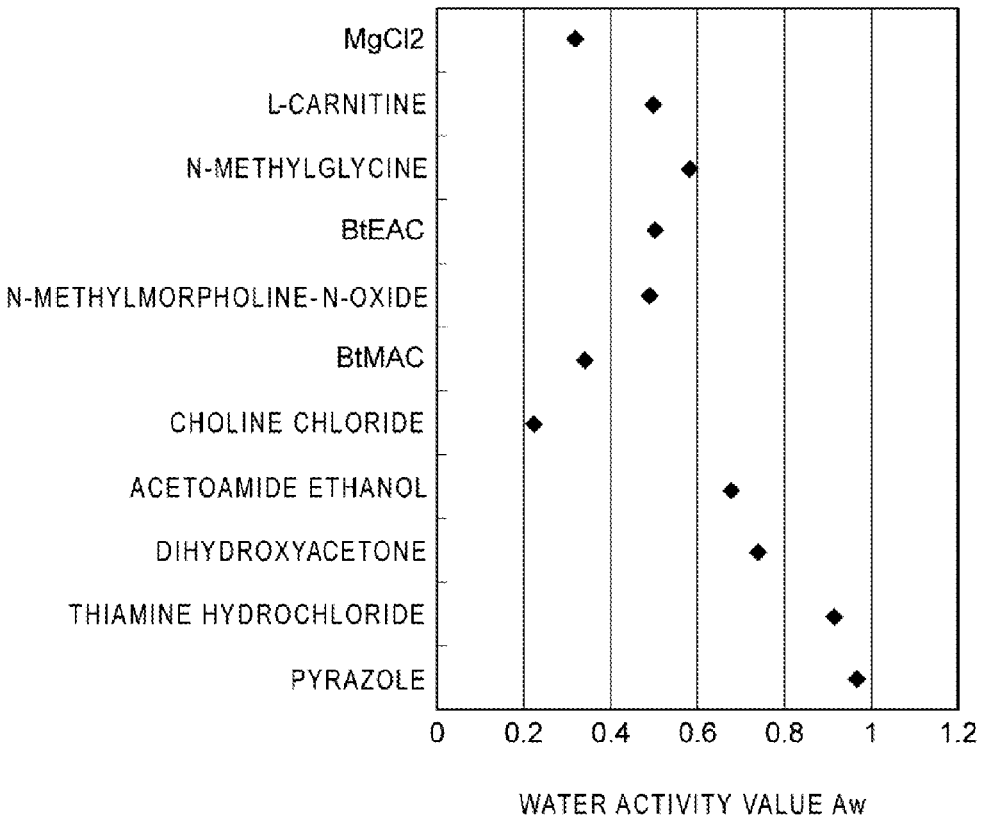
FIG. 7 is a graph illustrating water activity values of deliquescent materials.

FIG. 7 illustrates an example of the deliquescent material. A water retention ability of the deliquescent material is evaluated using a water activity value. The water retaining effect is increased as the water activity value is decreased. In FIG. 7, the deliquescent material having the water activity value Aw of 0.6 or less especially effectively suppresses the wavy edge and curling of the sheet. The following materials can be cited as examples of the deliquescent material having the water activity value of 0.6 or less. Examples include magnesium chloride, L-carnitine, N-methylglycine, benzyltriethylammonium chloride (BtEAC), N-methylmorpholine-N-oxide, benzyltrimethylammonium chloride (BtMAC), and choline chloride.

FIG. 4B illustrates the results in which the change in water amount is checked by adding the deliquescent material to the sheet. At this point, a 50% choline chloride aqueous solution is added as the deliquescent material to the sheet using the water addition apparatus in FIG. 3. As a result, it is found that the water amount after 24 hours is larger in the case that the 50% choline chloride aqueous solution is added as the deliquescent material is larger than the case that the 50% choline chloride aqueous solution is not added in the water. It can also be seen that the deliquescent material keeps the moisture in the sheets.

Similarly, as described above, the aqueous solution containing the surfactant having the hydrophilic group and the hydrophobic group may be used as the spraying water. When the aqueous solution containing the surfactant is sprayed to the sheet to improve the permeability of the solution to the sheet, the solution easily invades between the fibers to enhance the effect of cutting off the hydrogen bonding between the fibers, and the curling and wavy edge of the sheet can be reduced.

Spraying the solution only could leave droplets on the surface of the sheet, resulting in possible adhesion between the upper and lower sheets when many sheets are stacked. Therefore, the surfactant is mixed in the solution to enhance the permeability, and the droplets on the surface are quickly absorbed in the sheet, which allows a sheet stacking property to be improved.

Figure 8:
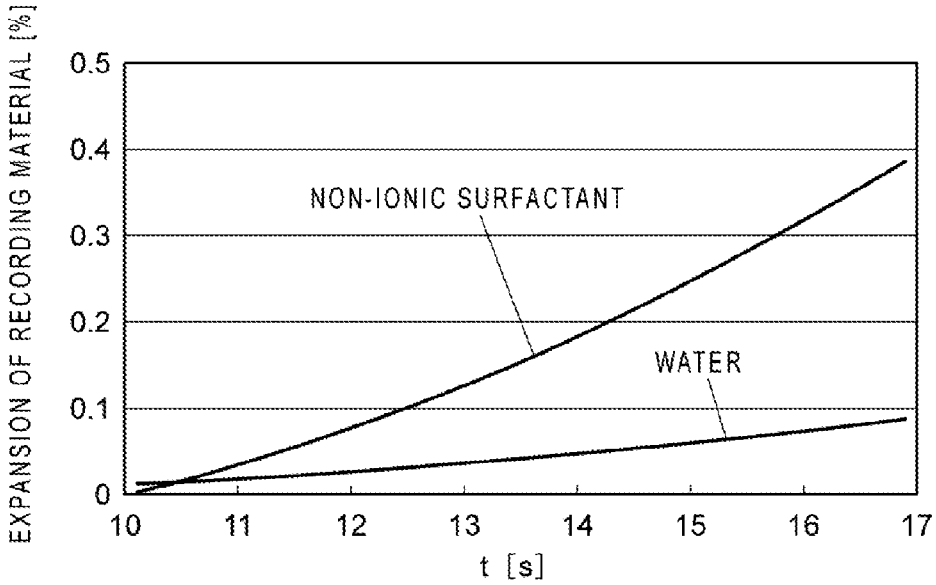
FIG. 8 is a graph illustrating expansion rates of an aqueous solution containing a surfactant and the sheet.

A non-ionic surfactant acetylene glycol is used as the surfactant. FIG. 8 illustrates measurement of the expansion and contraction of the sheet when only the aqueous solution containing the surfactant at a rate of 1% and the water are applied to the sheet. Because the sheet is expanded when the water invades in the sheet, it can be determined that the permeability is high when the expansion rate is high. As can be seen from FIG. 8, the aqueous solution containing the surfactant has higher permeability than the water.

The aqueous solution containing the deliquescent material is sprayed to the sheet using the water addition apparatus in FIG. 3 immediately after the sheet passing, and the wavy edge height is measured. The wavy edge height is measured when 20 sheets are stacked. The measurement is performed immediately after the spraying and after 48 hours to check the change in wavy edge height. In surroundings of the sheet that is of a product, the temperature is set to about 23° C., and humidity is set to about 40%. At this point, in the fixing roller of the electrophotographic image forming apparatus, the temperature is set to 180° C., and the circumferential velocity is set to 500 mm/sec. Accordingly, the speed of each sheet passing through the water addition apparatus is 500 mm/sec. The 50% choline chloride aqueous solution containing the deliquescent material and a 50% N-methylmorpholine-N-oxide aqueous solution having the deliquescent property and a function of cutting off the hydrogen bonding between the fibers are used as the spraying solution. The N-methylmorpholine-N-oxide belongs to a compound group including an amine oxide.

FIG. 4C illustrates the results. When the aqueous solution containing the deliquescent material is sprayed, the wavy edge of the sheet is reduced, and the wavy edge does not get worse and retains in the reduced state after 48 hours. In the case that the spraying is not performed to the sheet, the water amount becomes 4.4% immediately after the sheet passing and 5.5% after 48 hours. On the other hand, in the case that the 50% choline chloride aqueous solution is sprayed to the sheet, the water amount becomes 7.7% immediately after the sheet passing and 6.0% after 48 hours. In the case that the 50% N-methylmorpholine-N-oxide aqueous solution is sprayed to the sheet, the water amount becomes 6.5% immediately after the sheet passing and 5.8% after 48 hours. As can be seen from the results in FIG. 4C, in the case that the aqueous solution containing the deliquescent material is sprayed, the water amount of the sheet can be retained as well as the wavy edge height is decreased. It is also found that the solution containing the deliquescent material having the function of cutting off the hydrogen bonding between the fibers of the sheet has the large effect of reducing the wavy edge.

The N-ethylmorpholine-N-oxide has the same effect as the N-methylmorpholine-N-oxide to reduce the curling and the wavy edge. The amine oxide or an amine-N-oxide mean a compound group in which a general structural formula is expressed by R3N+—O— (in other expressions, R3N═O, or R3N→O). A dipole moment of a semi-polarity bonding N→O of the amine oxide indicates a high ionization tendency. The amine oxide is dissolved easily in water or alcohol because of a characteristic similar to that of a salt, and an oxygen electron of a N→O bonding tends to be bonded with hydrogen because the oxygen electron has a weak negative charge. The tendency of the hydrogen bonding exerts absorbency of the amine oxide.

From the experiment, it can be confirmed that the addition of the aqueous solution containing the deliquescent material to the sheet effectively suppresses the wavy edge of the sheet.

The aqueous solution containing the deliquescent material is sprayed to the sheet using the water addition apparatus in FIG. 3 before the sheet passes through the fixing device, and the effect of suppressing the wavy edge and curling of the sheet is checked when the heat and pressure are applied by the fixing device.

This is very effective when the double-sided image formation is completed in the same apparatus main body like the second embodiment. In the case of the double-sided image formation, even if the water is added in the apparatus main body, the sheet passes through the fixing device again when the second image is formed. At this point, the water is evaporated from the sheet, the temporarily-added water runs out, and sometimes the effect of reducing the curling and wavy edge of the sheet is degraded.

However, when the aqueous solution containing the deliquescent material is added to the sheet, as described above, the deliquescent property remains in the sheet even if the water is temporarily decreased. Therefore, the water can be adjusted until the water amount of the sheet becomes the equilibrium state. Thereby, the curling and wavy edge of the sheet are effectively reduced.

In the case that the double-sided image formation is performed to the sheet, such as coated paper, in which the sheet surface is coated, for example in FIG. 3, sometimes the water is added only from the water addition apparatus 107*d* of the water addition apparatuses 107*c* and 107*d*. That is, in the case that the double-sided image formation is performed to the sheet having the sheet surface that hardly absorbs the water, sometimes the water is added only from the water addition apparatus 107*d* on the first image surface side of the sheet. On the opposite side (the side of the water addition apparatus 107*c*) to the first image surface, when the water remains on the surface on which the toner image is formed during the second printing, sometimes a transfer defect is generated. On the other hand, during the face-down discharge after the single-side image formation is performed to the sheet having the water-absorption property higher than that of the coated paper, when the color image is formed entirely on the first surface, the water is added to the surface opposite to the first surface because the water is hardly absorbed.

Figure 9:
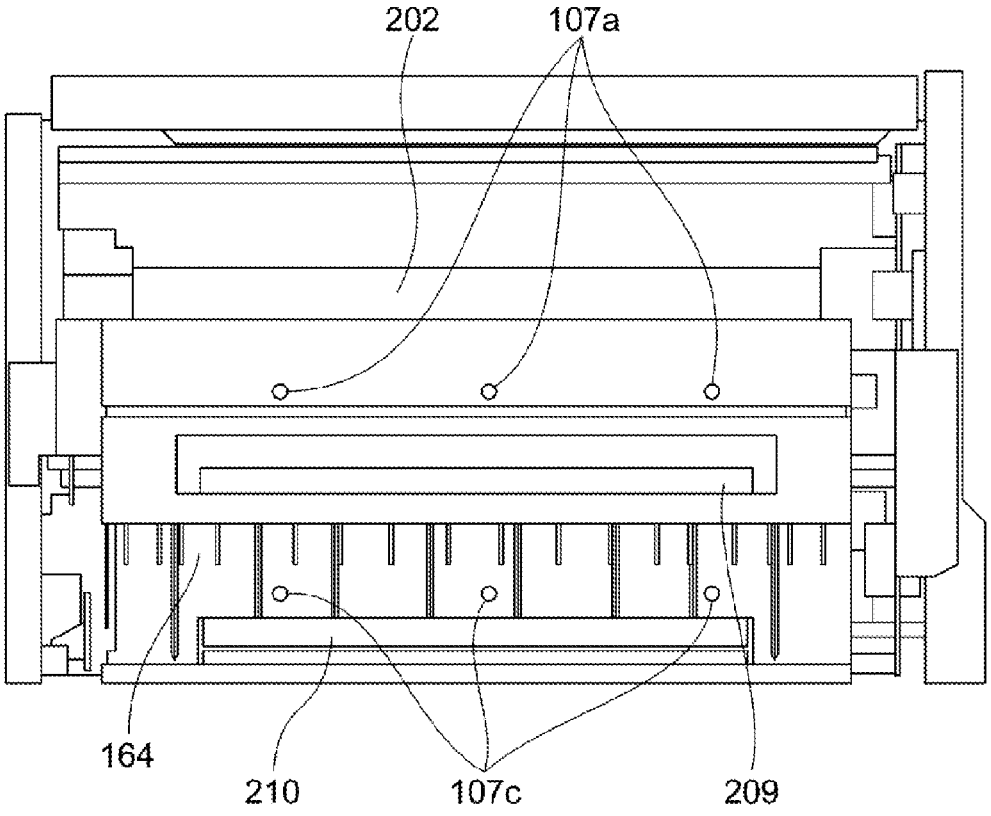
FIG. 9 is a partial plan view of a periphery of a switching member when viewed from a direction of an arrow Y.

FIG. 9 is a view when FIG. 1 is viewed from the direction of the arrow Y, and illustrates a state in which the outside conveying mechanism from the fixing device to the double-sided switching member is detached in the image forming apparatus. A set of three water addition apparatuses 107*a* and a set of three water addition apparatuses 107*c* disposed in the reverse switching member are disposed near the double-sided switching member 164. The water addition apparatuses 107*a* and 107*c* spray the water according to the sheet width (the length in the direction orthogonal to the conveying direction). In FIG. 9, the reverse switching member is not illustrated because it is attached to the outer guide.

The pair of reverse rollers 209 disposed on the downstream side in the conveying direction of the water addition apparatus 107*a* and the pair of double-sided rollers 210 disposed on the downstream side in the conveying direction of the water addition apparatus 107*c* are configured to be in contact with the whole region (a total width of the sheet) in the width direction orthogonal to the sheet conveying direction. In the case of the conveying roller that does not completely come into contact with the sheet in the total width of the sheet while the contact portion (roller portion) is divided in the width direction, sometimes the conveying roller comes into contact with the sheet before the sheet is incompletely dried, resulting in generation of a track of the roller. The configurations of reverse rollers 209 and double-sided rollers 210 prevent the generation of the track of the roller. The contact between the reverse rollers 209 and double-sided rollers 210 and the whole region in the sheet width direction uniforms the water added to the sheet to prevent the generation of the unevenness.

In the double-sided switching member 164, a contact portion that contacts with the sheet is constructed by plural ribs as illustrated in FIG. 9. When the sheet to which the water is added comes into contact a planar guide before the sheet is completely dried, sometimes the sheet adheres to the guide by an influence of the water, which results in a conveyance defect. The contact portion constructed by the plural ribs prevents the conveyance defect.

As described above, according to the second embodiment, the water is added by the water addition apparatus to the sheet in introducing and taking out the sheet in and from the switchback path, so that the water necessary to reduce the curling and wavy edge can be added to the sheet even if the sheet conveying speed is increased. Additionally, the unevenness of the water added to the sheet can be prevented because the water is added to the sheet in two batches.

Instead of the water, the aqueous solution containing the deliquescent material is added to the sheet, so that the evaporation of the added water can be prevented to keep the effect of reducing the curling and wavy edge of the sheet. As described above, the deliquescent material takes in the moisture in air to become the aqueous solution The deliquescent material stops absorbing the moisture when the water vapor pressure in air and the water vapor pressure in the aqueous solution are in equivalent with each other.

When the solution containing the non-volatile material that forms the hydrogen bonding with the fiber to suppress the hydrogen bonding between the fibers is added to the sheet instead of the water, the solution invades between the fibers to prevent the hydrogen bonding between the fibers irrespective of drying of the sheet. Therefore, the effect of reducing the curling and wavy edge of the sheet can be maintained.

The solution containing the non-volatile material contains the surfactant. The surfactant has a characteristic of including the hydrophilic group and the hydrophobic group, and has a function of weakening a surface tension. When the surfactant is mixed to enhance the permeability, the solution easily invades between the fibers, the effect of cutting off the hydrogen bonding between the fibers is enhanced and accordingly, the curling and wavy edge of the sheet are reduced to improve the stacking property.

The pair of conveying rollers disposed near the water addition apparatus is configured to be in contact with the whole region (total width of the sheet) in the width direction orthogonal to the sheet conveying roller, so that the generation of the track of the roller can be prevented in the sheet that is not completely dried.

In the double-sided switching member, the contact portion that contacts with the sheet is constructed by the plural ribs. Therefore, the conveyance defect, caused by the adhesion of the sheet to the guide due to the influence of the water added to the sheet, can be prevented.

In the above-described embodiments, the four image forming portions are used. However, the present invention is not limited to the four image forming portions, but the image forming portion may properly be provided as needed basis.

In the embodiments, the printer is demonstrated as the image forming apparatus. However, the invention is not limited to the printer. For example, the invention may be applied to other image forming apparatuses such as a copying machine and a facsimile machine or other image forming apparatuses such as a multifunction peripheral in which the functions of the printer, the copying machine, and the facsimile machine are combined. In the image forming apparatus of the embodiments, using the intermediate transfer member, the toner images of the colors are transferred to the intermediate transfer member in the sequentially superimposed manner, and the toner images borne on the intermediate transfer member are collectively transferred to the sheet. However, the invention is not limited to the image forming apparatus of the embodiments. For example, in an image forming apparatus, using a sheet bearing member, the toner images of the colors may be transferred to the sheet borne by the sheet bearing member in a sequentially superimposed manner. The same effect can be obtained when the invention is applied to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-107797, filed May 13, 2011, and No. 2012-097043, filed Apr. 20, 2012, which are hereby incorporated by reference herein in their entirety.

What is claimed is:

1. An image forming apparatus comprising:

a fixing portion that fixes a toner image to a sheet by applying heat to the sheet in which the toner image is formed;

a conveyance path including a normally and reversely rotatable conveying roller, through which back and forth conveyance of the sheet conveyed from the fixing portion is performed by normally and reversely rotating the conveying roller;

a water addition portion that adds water to the sheet at a water addition position in the conveyance path upstream in a conveying direction of the conveying roller during the normal rotation of the conveying roller; and a controller that controls the water addition portion such that the water is added to the sheet conveyed from the fixing portion to the water addition position, and that the water is added to the sheet to which reverse conveyance has been performed by the reverse rotation of the conveying roller after an upstream end in the conveying direction of the sheet during the normal rotation of the conveying roller passes through the water addition position.

2. The image forming apparatus according to claim 1, wherein the conveyance path is a path to reverse a sheet to be discharged.

3. The image forming apparatus according to claim 1, wherein the conveyance path is a path to reverse a sheet in which double-sided image formation is to be performed.

4. The image forming apparatus according to claim 1, wherein the conveying roller is configured to be in contact with a whole region in a width direction orthogonal to the sheet conveying direction.

5. The image forming apparatus according to claim 1, wherein the conveyance path includes a switching member that switches a sheet conveying route, and a contact portion that contacts with the sheet is constructed by a plurality of ribs in the switching member.

6. The image forming apparatus according to claim 1, wherein the water addition portions are disposed on both surface sides of the sheet while facing each other across the sheet conveying path, and the water addition portions add the water to a single side or double sides of the sheet.

7. The image forming apparatus according to claim 1, wherein the water addition portion includes a spray nozzle or a water-jet mechanism, which sprays the water to the sheet.

8. The image forming apparatus according to claim 1, wherein the water addition portion includes an applying roller that applies the water to the sheet.

9. A water addition apparatus comprising:

a conveyance path including a normally and reversely rotatable conveying roller, through which switchback conveyance of a sheet to which a toner image is fixed by applying heat is performed by normally and reversely rotating the conveying roller;

a water addition portion that adds water to the sheet at a water addition position in the conveyance path upstream in a conveying direction of the conveying roller during the normal rotation of the conveying roller; and a controller that controls the water addition portion such that the water is added to the sheet conveyed to the water addition position after the toner image is fixed, and the water is added to the sheet to which the switchback has been performed by the reverse rotation of the conveying roller after an upstream end in the conveying direction of the sheet during the normal rotation of the conveying roller passes through the water addition position.

10. The water addition apparatus according to claim 9, wherein the conveyance path is a path to reverse a sheet to be discharged.

11. The water addition apparatus according to claim 9, wherein the conveyance path is a path to reverse a sheet in which double-sided image formation is to be performed.

12. The water addition apparatus according to claim 9, wherein the conveying roller is configured to be in contact with a whole region in a width direction orthogonal to the sheet conveying direction.

13. The water addition apparatus according to claim 9, wherein the conveyance path includes a switching member that switches a sheet conveying route, and a contact portion that contacts with the sheet is constructed by a plurality of ribs in the switching member.

14. The water addition apparatus according to claim 9, wherein the water addition portions are disposed on both sides of the sheet while facing each other across the sheet conveying path, and the water addition portions add the water to a single side or double sides of the sheet.

15. The water addition apparatus according to claim 9, wherein the water addition portion includes a spray nozzle or a water-jet mechanism, which sprays the water to the sheet.

16. The water addition apparatus according to claim 9, wherein the water addition portion includes an applying roller that applies the water to the sheet.

* * * * *